US007530838B2

(12) United States Patent
Ohara

(10) Patent No.: US 7,530,838 B2
(45) Date of Patent: May 12, 2009

(54) CONNECTOR, A CONNECTOR ASSEMBLY AND AN ASSEMBLING METHOD THEREFOR

(75) Inventor: Koji Ohara, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/044,199

(22) Filed: Mar. 7, 2008

(65) Prior Publication Data

US 2008/0220639 A1 Sep. 11, 2008

(51) Int. Cl.
*H01R 3/00* (2006.01)

(52) U.S. Cl. ..... 439/489; 439/595; 439/752

(58) Field of Classification Search ..... 439/488, 439/489, 595, 752
See application file for complete search history.

(56) References Cited

U.S. PATENT DOCUMENTS 5,775,936 A * 7/1998 Tsuji ..... 439/489
6,712,635 B1 * 3/2004 Nimura ..... 439/352
6,837,733 B2 * 1/2005 Katsuma ..... 439/352
7,059,902 B2 * 6/2006 Nakamura ..... 439/595
7,204,726 B2 * 4/2007 Yamashita et al. ..... 439/752
7,294,013 B2 * 11/2007 Nakamura ..... 439/489

FOREIGN PATENT DOCUMENTS

JP 2000-252012 9/2000

* cited by examiner

*Primary Examiner*—James Harvey
(74) *Attorney, Agent, or Firm*—Gerald E. Hespos; Anthony J. Casella

(57) ABSTRACT

Shorting terminals (80) for shorting pairs of terminal fittings (20) are accommodated in a female housing (10), and releasing portions (34) for releasing the shorted state of the pairs of terminal fittings (20) are provided in the male housing (30). Further, a detector (50) is mounted in the female housing (10) for movement between a standby position and a detection position. The detector (50) is permitted to move from the standby position to the detection position while being linked with the operation of the releasing portion (34) after the shorted state of the terminal fittings (20) by the releasing portion (34) is released.

12 Claims, 16 Drawing Sheets

CD
(FBD)

CD
(FBD)

CONNECTOR, A CONNECTOR ASSEMBLY AND AN ASSEMBLING METHOD THEREFOR

BACKGROUND OF THE INVENTION

1. Field of the Invention

The invention relates to a connector provided with a shorting terminal and to a respective connector assembly.

2. Description of the Related Art

An airbag of an automotive vehicle has a circuit with a pair of terminal fittings. A potential difference between the terminal fittings could cause the airbag to operate inadvertently when the circuit is opened for maintenance or other reason. Accordingly, an airbag circuit typically includes a shorting terminal to prevent a potential difference between the terminal fittings.

Japanese Unexamined Patent Publication No. 2000-252012 discloses an airbag connector with two terminal fittings accommodated in a female housing. A mounting space for a shorting terminal is defined below these two terminal fittings, and the terminal fittings are shorted by a shorting terminal mounted into this mounting space from the front. A detecting terminal also is mounted in the female housing and is connected with a mating detecting terminal to close a detection circuit when the female housing is connected properly with a mating male housing. Thus, proper connection of the two housings can be detected electrically.

The above-described connector indirectly guarantees that a short circuit by the shorting terminal is opened if the detection circuit by the detecting terminal is closed. However, there has been a demand for an easy mechanical method to detect whether a shorted state of the terminal fittings has been released.

The present invention was developed in view of the above situation and an object thereof is to detect mechanically whether or not a shorted state of a pair of terminal fittings has been released.

SUMMARY OF THE INVENTION

The invention relates to a connector with a housing to be connected with a mating housing of a mating connector. At least two terminal fittings are accommodated in the housing. At least one shorting terminal also is accommodated in the housing and is adapted to contact and short the terminal fittings. At least one releasing portion in the mating housing releases the shorted state of the terminal fittings as the housing is connected with the mating housing. At least one detector is mounted in the housing and is movable between a standby position and a detection position. The detector is capable of reaching the detection position only when the housing is connected properly with the mating housing and can move from the standby position to the detection position after the shorted state of the terminal fittings is released by the releasing portion.

Movement of the detector from the standby position to the detection position is permitted after the shorted state of the terminal fittings is released by the releasing portion during the connection of the two housings. Thus, a release of the shorted state of the terminal fittings is detected mechanically if the detector is permitted to move to the detection position.

At least one stopper preferably is provided in the housing for holding the detector at the standby position.

The detector preferably contacts the releasing portion upon entering the housing. The releasing portion enables the detector to separate from the stopper and permits the detector to move to the detection position. Thus, detection of whether a short circuit has been opened is guaranteed with high accuracy and is linked with the release of the shorting state of the shorting terminal The housing preferably has a guiding groove to define a movement path for the detector from the standby position to the detection position. The detector moves smoothly along the guiding groove as the housings are connected.

The construction of the connector is simplified by commonly using one releasing portion to release the shorting state of the shorting terminal and to move the detector to the detection position.

The guiding groove preferably is located within the height range of a detector accommodating chamber in the housing.

The guiding groove preferably comprises a standby side groove that extends along a connecting direction of the housing back from the starting end, an oblique groove that extends obliquely out towards the front from the rear end of the standby side groove and a detection side groove that extends along the connecting direction forward from the upper end of the oblique groove. The detector is movable from the starting end of the standby side groove to the finishing end of the detection side groove via the oblique groove with respect to the housing.

An accommodation space for the shorting terminal preferably is provided in the housing and also functions as a mounting space for the detector. Thus, the detector can be mounted without significantly changing the construction of an existing housing and without enlarging the housing.

A movement path for the detector from the standby position to the detection position preferably is defined so that the detector passes a temporary stop position where the movement of the detector is stopped temporarily.

A rear end of the detector preferably is aligned with a rear end surface of the housing when the detector reaches the detection position.

The invention also relates to a connector assembly comprising the above-described connector and a mating connector connectable therewith.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
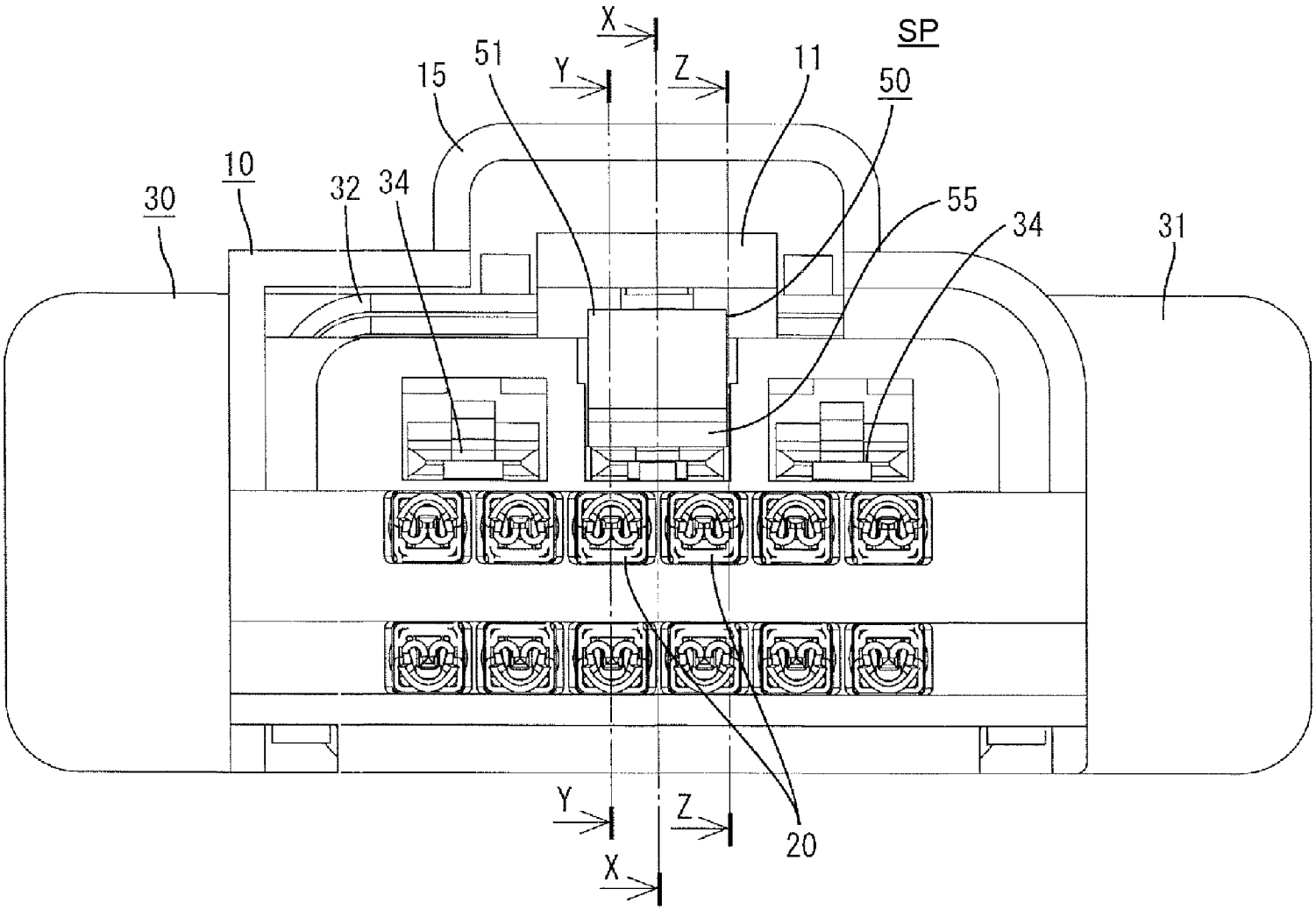
FIG. 1 is a rear view of a female housing connected with a male housing with a detector held at a standby position in one embodiment.

A connector assembly in accordance with the invention is described with reference to FIGS. 1 to 16. This connector assembly has male and female housings 10, 30 connectable with each other. A detector 50 is mounted in the female housing 10 for movement between a standby position SP and a detection position DP. Terminal fittings 20 are accommodated in the female housing 10 and form part of an airbag circuit of an automotive vehicle. A shorting terminal 80 also is accommodated in the female housing 10 for shorting at least one pair of terminal fittings 20. In the following description, ends of the housings 10, 30 to be connected with each other are referred to as the front.

Figure 8:
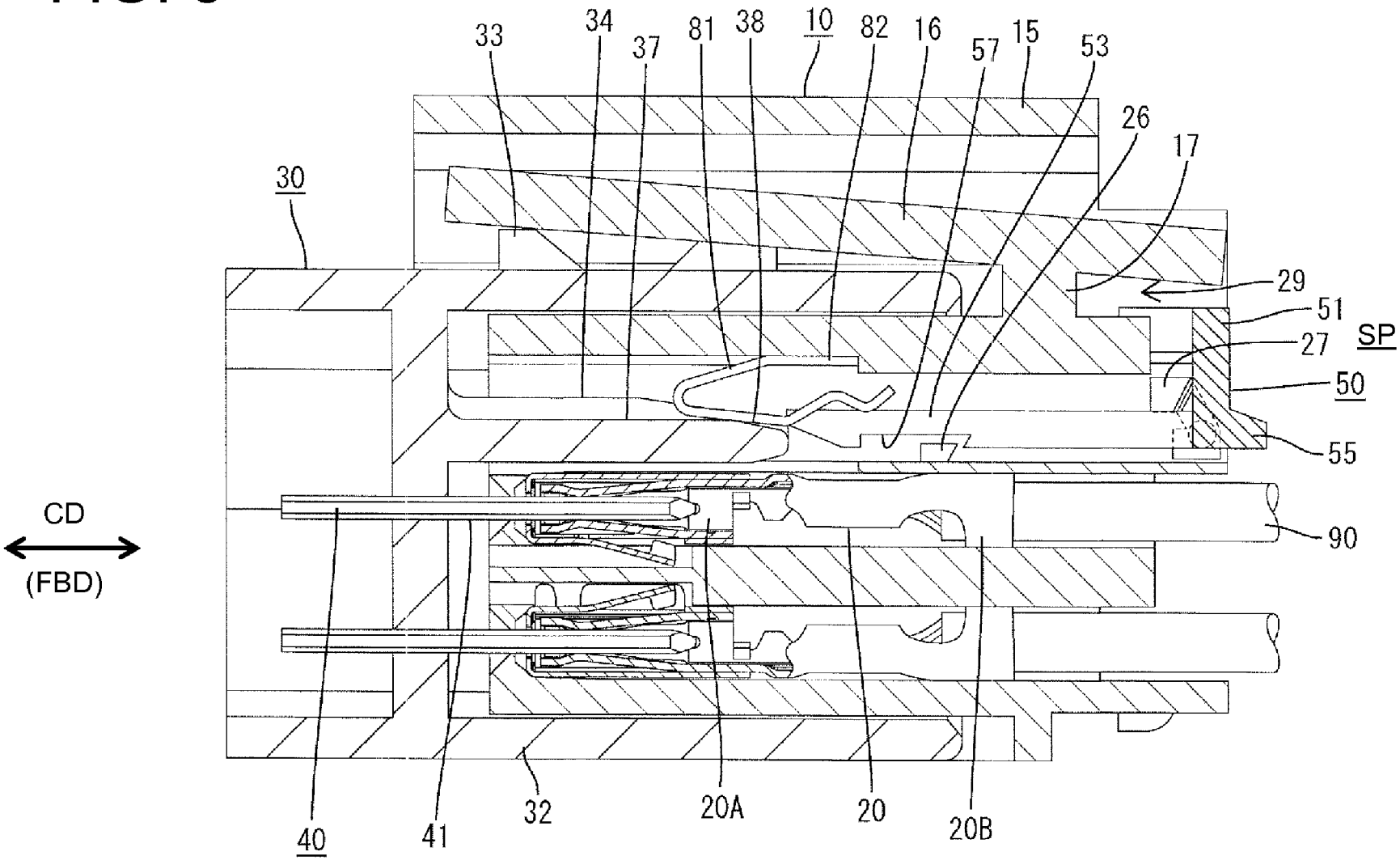
FIG. 8 is a cross section taken along line Y-Y section of FIG. 1 when the shorted state of the pair of terminal fittings is released.
Figure 14:
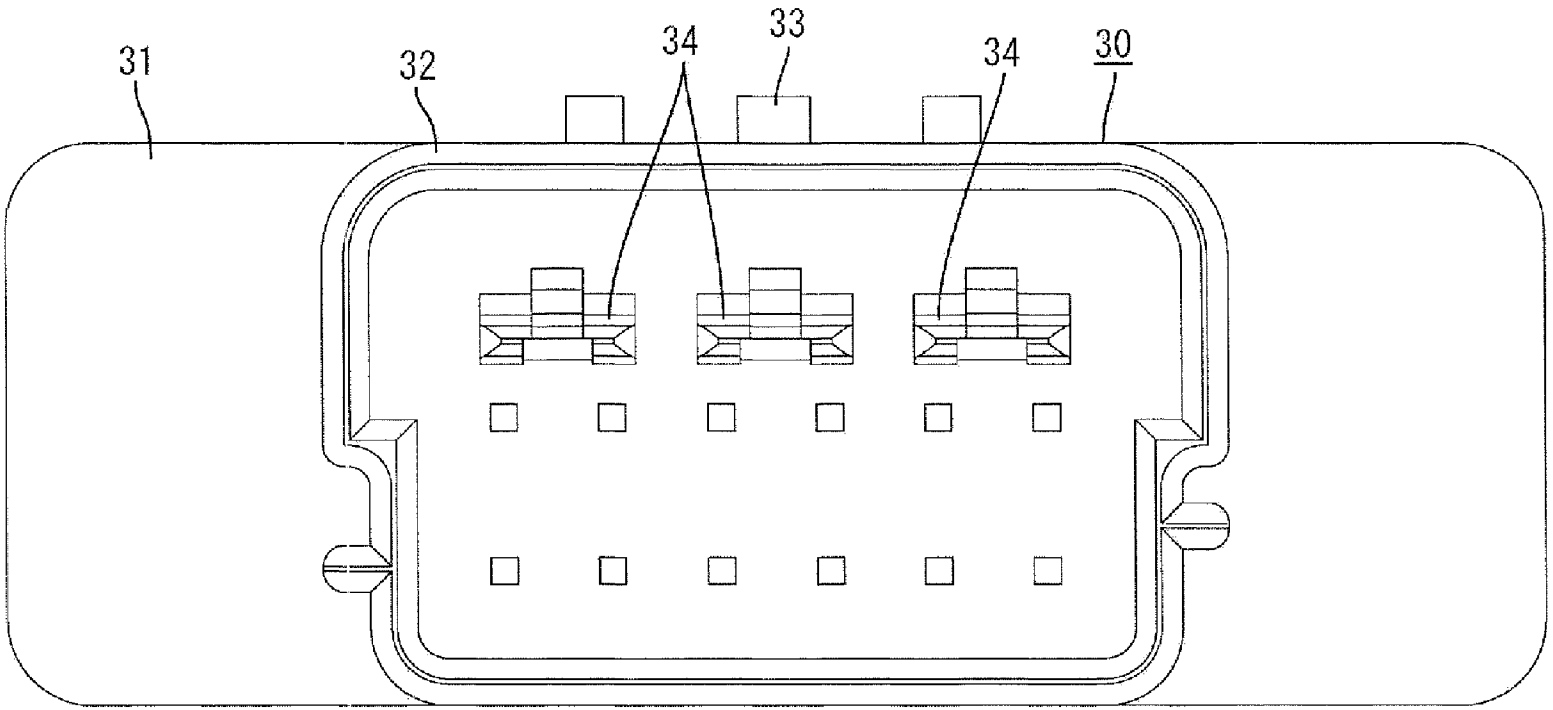
FIG. 14 is a front view of the male housing.
Figure 15:
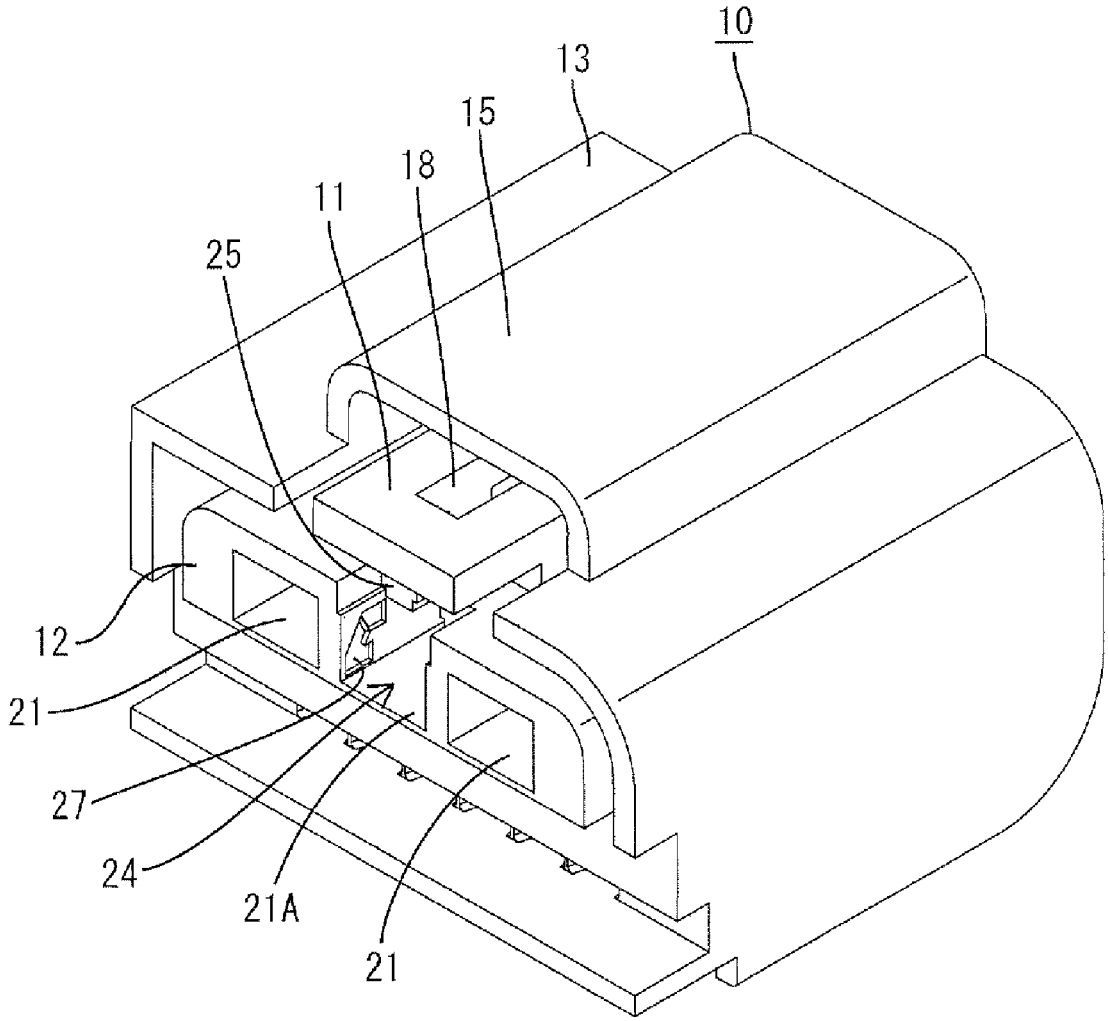
FIG. 15 is a perspective view of the female housing before the detector is mounted.

The male housing 30 is made e.g. of a synthetic resin and includes a base wall 31 that is substantially rectangular when viewed from the front. A rectangular tubular receptacle 32 projects forward from the front surface of the base wall 31 as shown in FIG. 14. As shown in FIG. 8, male terminal fittings 40 are mounted through the base wall 31, and tabs 41 of the mounted male terminal fittings 40 project into the receptacle 32. An interlocking portion 33 projects in a widthwise intermediate position of the upper surface of the upper wall of the receptacle 32.

Releasing portions 34 are formed substantially side by side on the front surface of the base wall 31 and are located at substantially the same height. The releasing portions 34 are shaped and sized identically, and the projecting ends thereof are at the same position in forward and backward directions FBD. Each releasing portion 34 is a long narrow substantially horizontal strip that projects in forward and backward directions FBD for insertion into the female housing 10. A tall rib 35 is formed in forward and backward directions FBD in a widthwise intermediate position on each releasing portion 34. Releasing main portions 36 are formed on opposite sides of the rib 35 of the releasing portion 34. Substantially horizontal releasing slide surfaces 37 are defined on the upper surfaces of the releasing main portions 36 and are slightly lower than the upper surface of the rib 35. Releasing guide surfaces 38 are provided at the front ends of the releasing slide surfaces 37 and are inclined up and towards the back.

The releasing portion 34 in the lateral center also has a movement guide surface 39 provided at the front end of the upper surface of the rib 35 thereof. The movement guide surface 39 is elongated in forward and backward directions FBD and is inclined up and towards the back with a more moderate inclination than the releasing guide surfaces 38.

The female housing 10 is made e.g. of a synthetic resin and has a block-shaped terminal accommodating portion 12. A cover 13 surrounds the terminal accommodating portion 12 and a connecting portion 14 is continuous with the outer surface of the terminal accommodating portion 12 and the inner surface of the cover 13 at the rear end.

A substantially U-shaped bulge 15 is formed in a widthwise intermediate position of the upper wall of the connecting portion 13, and a lock arm 11 is between the bulge 15 and the terminal accommodating portion 12. The lock arm 11 includes a beam 16 that is long and narrow in forward and backward directions FBD and a support 17 connected with the upper surface of the terminal accommodating portion 12 near the rear end of the beam 16 and at substantially the same position as the connecting portion 14 in forward and backward directions FBD. The beam 16 is pivotally and resiliently displaceable like a seesaw about the support 17. A lock groove 18 is formed in a lengthwise intermediate part of the beam 16 and engages the interlocking portion 33 when the two housings 10, 30 are connected properly to lock the housings 10, 30 together.

The terminal accommodating portion 12 has cavities 19 at upper and lower stages for accommodating female terminal fittings 20, including the terminal fittings 20 of the airbag circuit. A box 20A is formed at the front end of each terminal fitting 20 and is configured for receiving the tab 41. A fixing portion 20B is formed at the rear end of each terminal fitting 20 and can be fixed firmly to an end of a wire 90. The terminal accommodating portion 12 also has three shorting-terminal accommodating chambers 21 arranged side by side in the width direction above the cavities 19 at the upper stage. The shorting-terminal accommodating chambers 21 are at positions corresponding to the releasing portions 34 of the male housing 30 and accommodation spaces 22 are defined in the shorting-terminal accommodating chambers 21. A front widthwise intermediate part of each shorting-terminal accommodating chamber 21 communicates with the cavities 19 at the upper stage that accommodate the terminal fittings 20 that are to be shorted. A step 23 is formed on an inner wall of the shorting-terminal accommodating chamber 21 and aligns with the rear end of the communicating portion.

Each shorting-terminal accommodating chamber 21 has a substantially rectangular cross section that is larger than the cavities 19. The shorting-terminal accommodating chamber 21 in the lateral center defines a detector accommodating chamber 21A for receiving the detector 50. A front end of the interior of the detector accommodating chamber 21A defines an accommodation space 22 for the shorting terminal 80 and a rear end of the detector accommodating chamber 21A defines a mounting space 24 for the detector 50. A cutout 25 is made in the upper wall of the rear end of the detector accommodating chamber 21A and faces the rear end of the beam 16 of the lock arm 11. The mounting space 24 for the detector 50 also includes a space defined by the rear surface of the support 17 of the lock arm 11 and the lower surface of the rear end of the beam 16 via the cutout 25.

At least one stopper 26 projects at a position slightly behind the center of the bottom surface of the detector accommodating chamber 21A in forward and backward directions for preventing the detector 50 from moving forward and lifting from the detection position DP. The stopper 26 is substantially dovetailed and the upper end of the rear surface thereof is undercut to overhang.

Figure 11:
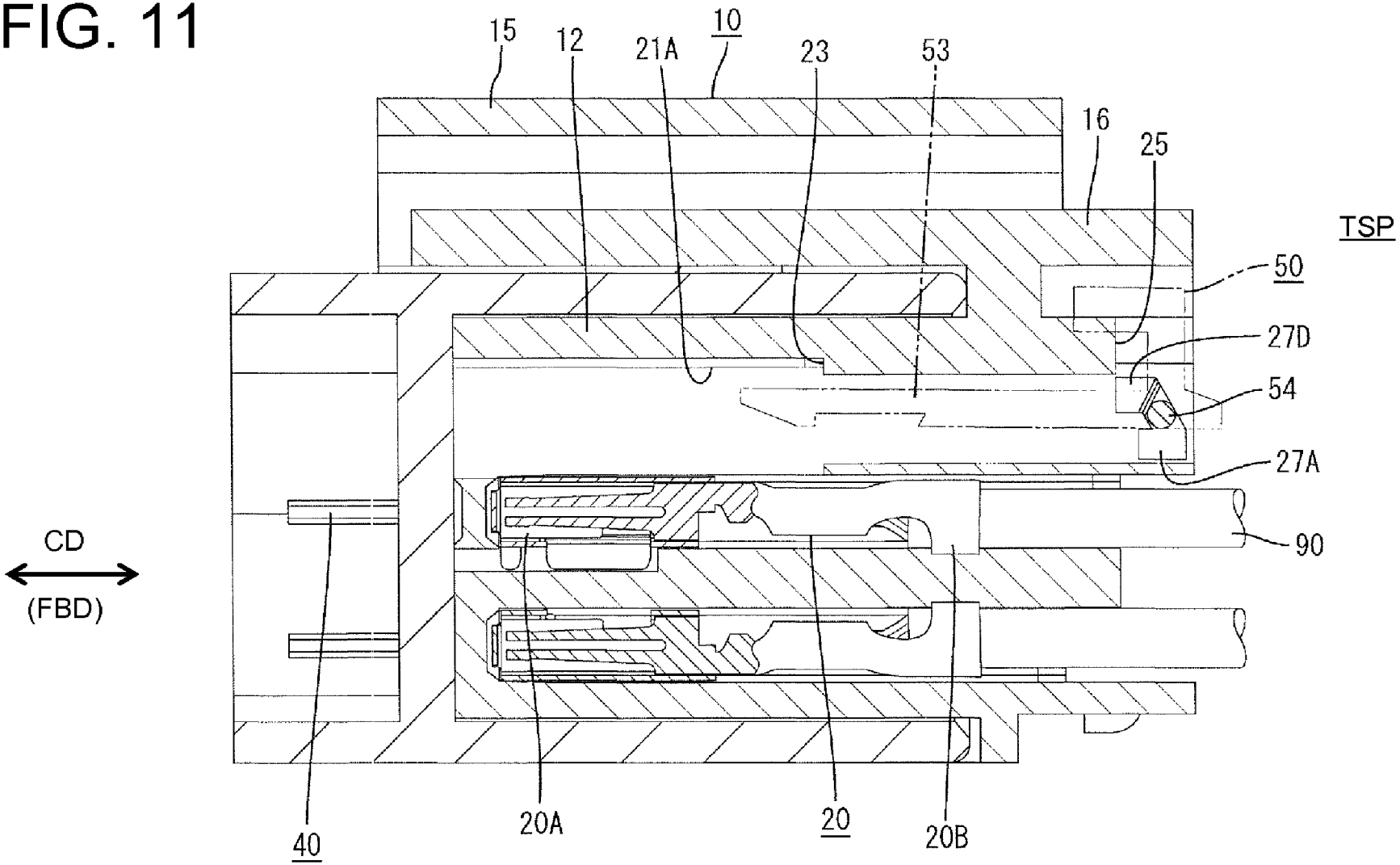
FIG. 11 is a cross section taken along line Z-Z section of FIG. 1 when the detector reaches the temporary stop position.
Figure 12:
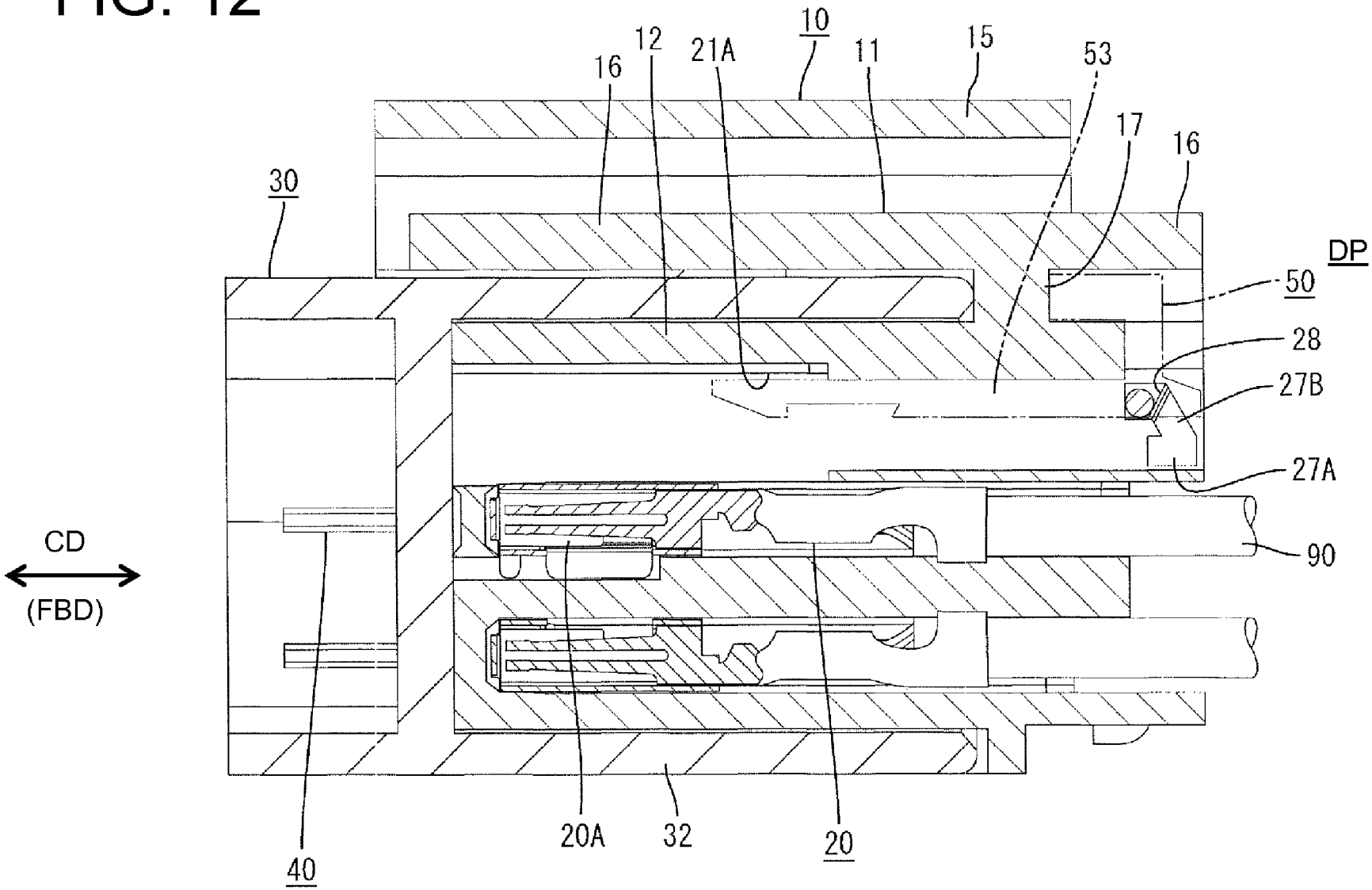
FIG. 12 is a cross section taken along line Z-Z section of FIG. 1 when the detector reaches the detection position.
Figure 13:
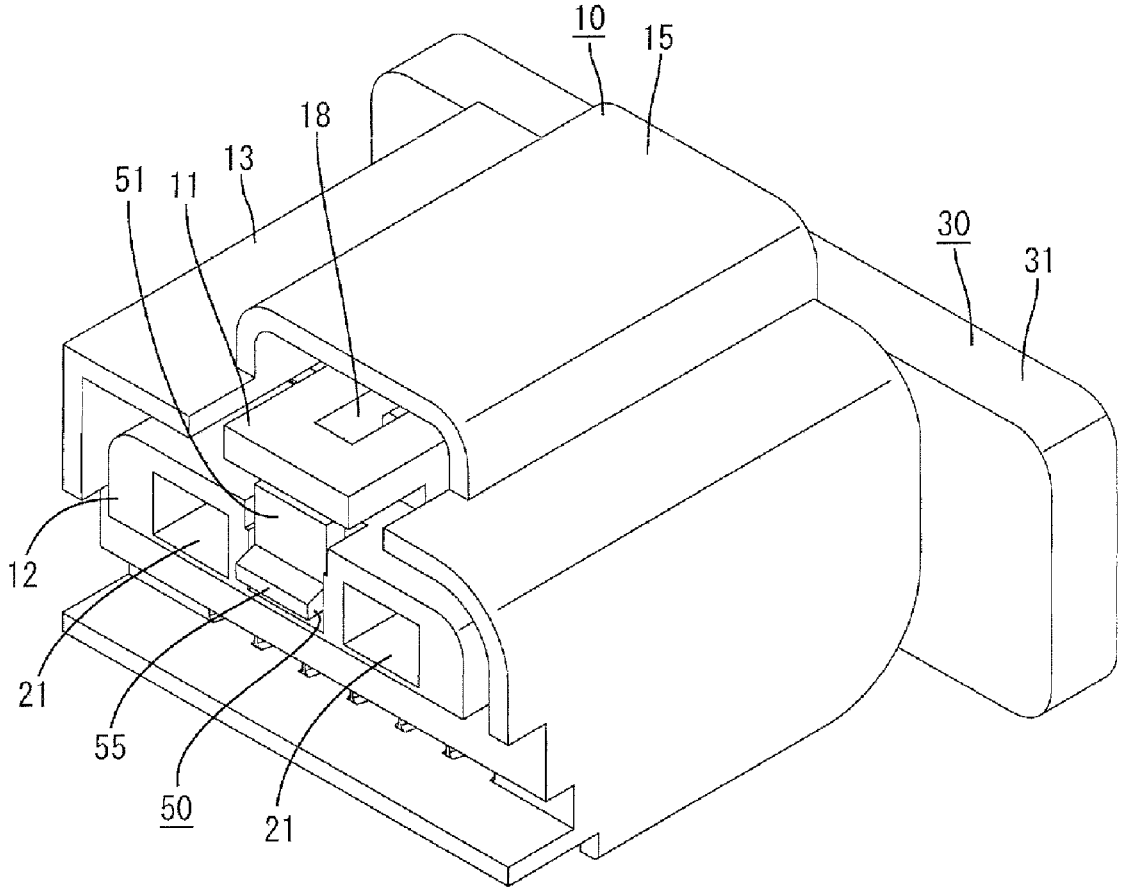
FIG. 13 is a perspective view of the female housing properly connected with the male housing with the detector held at the temporary stop position.

Bottomed guiding grooves 27 are formed at the left and right inner surfaces of the rear end of the detector accommodating chamber 21A for guiding a movement of the detector 50 from the standby position SP to the detection position DP. As shown in FIGS. 11 and 12, each guiding groove 27 is within the height range of the detector accommodating chamber 21A and is comprised of a substantially horizontal standby side groove 27A extending along the forward and backward directions FBD back from the starting end, an oblique groove 27B extending obliquely up towards the front from the rear end of the standby side groove 27A and a substantially horizontal detection side groove 27D extending along the forward and backward directions FBD forward from the upper end of the oblique groove 27B to the finishing end. The detector 50 is movable from the starting end of the horizontal standby side groove 27A to the finishing end of the horizontal detection side groove 27D via the oblique groove 27B with respect to the female housing 10. The finishing end of the horizontal detection side horizontal groove 27D is at substantially the same position as the cutout 25 of the detector accommodating chamber 21A in forward and backward directions FBD. An elongated projection 28 extends obliquely at a boundary between the oblique groove 27B and the horizontal detection side groove 27D, and a temporary stop position TSP is set before the elongated projection 28 where the movement of the detector 50 is stopped temporarily.

Each shorting terminal 80 is formed by bending an electrically conductive metallic plate to define a substantially planar main portion 82 and two resilient contact pieces 81 that extend from the front end of the main portion 81. The spacing between the resilient contact pieces 81 is substantially the same as the spacing between the corresponding adjacent cavities 19 at the upper stage. Each resilient contact piece 81 extends forward and then is folded back, and the folded side has a double-peak that projects down towards the respective cavities 19. The front peak defines a contact 83 for resiliently contacting the box 20A of the terminal fitting 20 from above and in a direction intersecting the connecting direction CD, and the front slant of the front peak can slide in contact with the releasing guide surface 38 of the corresponding releasing portion 34. The rear peak resiliently contacts the inner bottom surface of the shorting-terminal accommodating chamber 21. The resilient contact piece 81 is deformed resiliently about the front end of the main portion 82 upon contacting the releasing portion 34, and moves onto the releasing slide surface 37 of the releasing portion 34 while remaining resiliently deformed.

Figure 16:
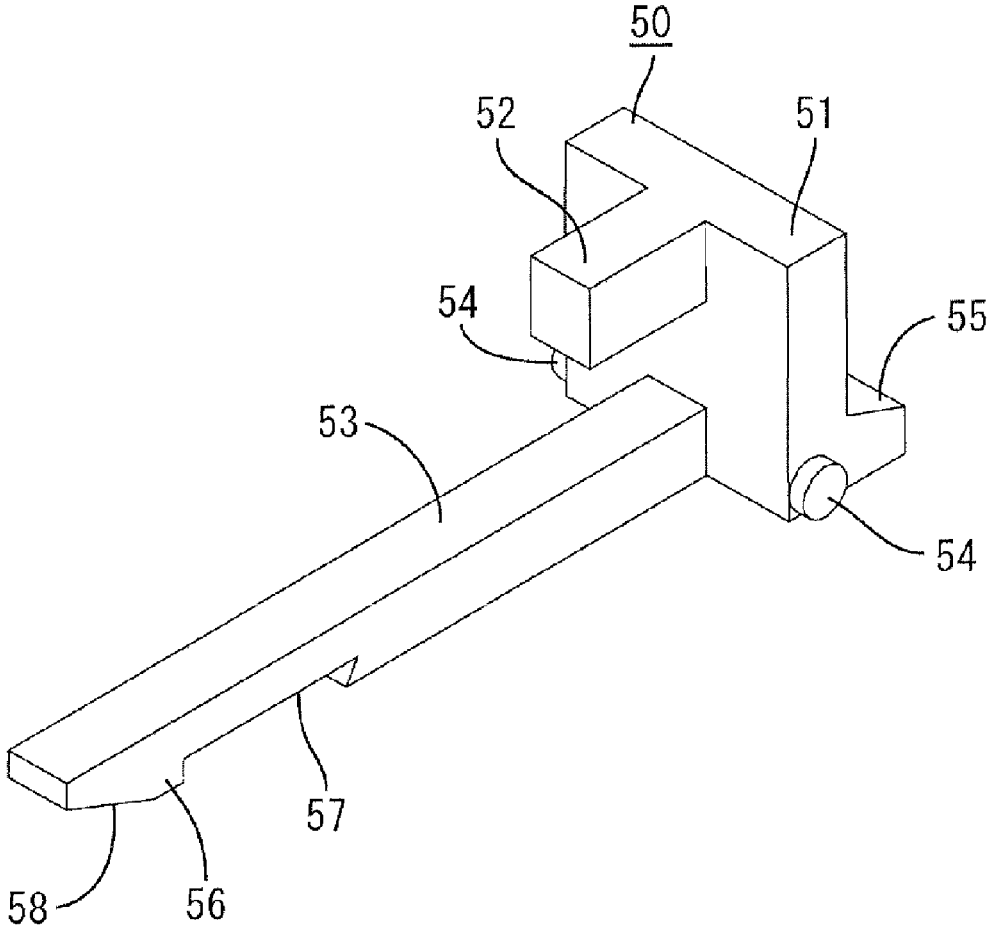
FIG. 16 is a perspective view of the detector.

The detector 50 is made e.g. of a synthetic resin and has a long narrow oblong shape for insertion into the mounting space 24 of the detector accommodating chamber 21A. The detector 50 includes a rectangular operating plate 51 aligned substantially vertically or at a steep angle to the connecting direction CD, as shown in FIG. 16. A short rectangular bar-shaped entrance piece 52 projects forward substantially from the center of the upper end of the front surface of the operating plate 51. A long rectangular bar-shaped engaging piece 53 projects forward substantially from the center of the bottom end of the front surface of the operating plate 51. Two very short left and right guiding projections 54 project sideways from the bottom ends of the left and right surfaces of the operating plate 51. The guiding projections 54 are substantially cylindrical and can slide in contact with the surfaces of the guiding grooves 27.

A detection rib 55 is formed over substantially the entire width at the bottom end of the rear surface of the operating plate 51. The detection rib 55 can be seen from the outside and the rear end surface thereof is more backward than the rear end surface of the female housing 10 until the detector 50 reaches the detection position DP. The rear end surface of the detection rib 55 aligns with the rear end surface of the female housing 10 when the detector 50 reaches the detection position DP, and the upper surface thereof is concealed by the rear end of the arm 16. Accordingly, whether the detector 50 has reached the detection position DP can be confirmed by checking whether the detection rib 55 is projecting.

The entrance piece 52 has a height substantially equal to a clearance between the lower surface of the beam 16 and the upper surface of the terminal accommodating portion 12. The entrance piece 52 can enter the space 29 between the beam 16 and the terminal accommodating portion 12 if the lock arm 11 is in a natural state, whereas entry into the entrance space 29 is hindered if the lock arm 11 is deformed.

The engaging piece 53 has a long narrow shape for insertion into the mounting space 24 along the bottom surface of the detector accommodating chamber 21A. An engaging claw 56 is formed at the leading end of the engaging piece 53 for resiliently contacting the releasing portion 34, and an engaging groove 57 is formed in the lower surface of the engaging piece 53 immediately behind the engaging claw 56 for receiving the stopper 26 of the female housing 10. A guiding slant 58 is formed on the lower surface of the engaging claw 56 and is inclined up towards the front for sliding contact with the movement guide surface 39 of the releasing portion 34. A contact position of the engaging claw 56 and the releasing portion 34 is more backward than a contact position of the resilient contact pieces 81 and the releasing portion 34 in forward and backward directions. Thus, the engaging claw 56 contacts the releasing portion 34 later than the shorting terminal 80 does. The engaging groove 57 is dovetailed, and the upper end of the inner rear surface thereof is undercut backward to overhang and contacts the rear surface of the stopper 26 to prevent a movement of the detector 50 towards the detection position DP along the oblique grooves 27B. The engaging groove 57 is longer in forward and backward directions FBD than the stopper 26 so that the stopper 26 is movable in forward and backward directions FBD in the engaging groove 57. The detector 50 is moved obliquely up towards the front by passing the oblique grooves 27B in the process of moving from the standby position SP to the detection position DP and, thereafter, is pushed forward to move the guiding projections 54 over the elongated projections 28 to reach the detection position DP. The detector 50 is kept substantially horizontal posture during the movement.

The connector is assembled by inserting the detector 50 into the mounting space 24 of the detector accommodating chamber 21A. Thus, the guiding projections 54 enter the horizontal standby side grooves 27A of the guiding grooves 27 of the detector accommodating chamber 21A, the engaging piece 53 is arranged along the inner wall of the detector accommodating chamber 21A, the stopper 26 is fit into the engaging groove 57 and the entrance piece 52 is fit into the cutout 25 of the detector accommodating chamber 21A to be substantially continuous with the upper wall of the detector accommodating chamber 21A. The inner rear surface of the engaging groove 57 contacts the rear surface of the stopper 26 and the front end of the entrance piece 52 contacts the cutout 25 to prevent a forward movement of the detector 50 when the detector 50 reaches the standby position SP. Additionally, the guiding projections 54 are fit into the guiding grooves 27 to prevent a backward movement of the detector 50. The contact of the inner front surface of the engaging groove 57 and the front surface of the stopper 26 prevents any further backward movement of the detector 50 even if the guiding projections 54 come out of the guiding grooves 27. More particularly, the dovetail engagement of the inner rear surface of the engaging groove 57 and the rear surface of the stopper 26 prevents the detector 50 from moving obliquely up to the front along the inclined surfaces.

The shorting terminals 80 are inserted into the accommodation spaces 22 of the shorting-terminal accommodating chambers 21 substantially concurrently with the mounting of the detector 50 to fix the main portions 82 to the stepped engagement portions 23. The contacts 83 of the resilient contact pieces 81 then enter the corresponding cavities 19. The terminal fittings 20 then are inserted into the cavities 19 from behind. The contacts 83 of the resilient contact pieces 81 contact the upper surfaces of the boxes 20A of the two terminal fittings 20 to short the terminal fittings 20 with each other when the terminal fittings 20 are inserted properly.

Figure 2:
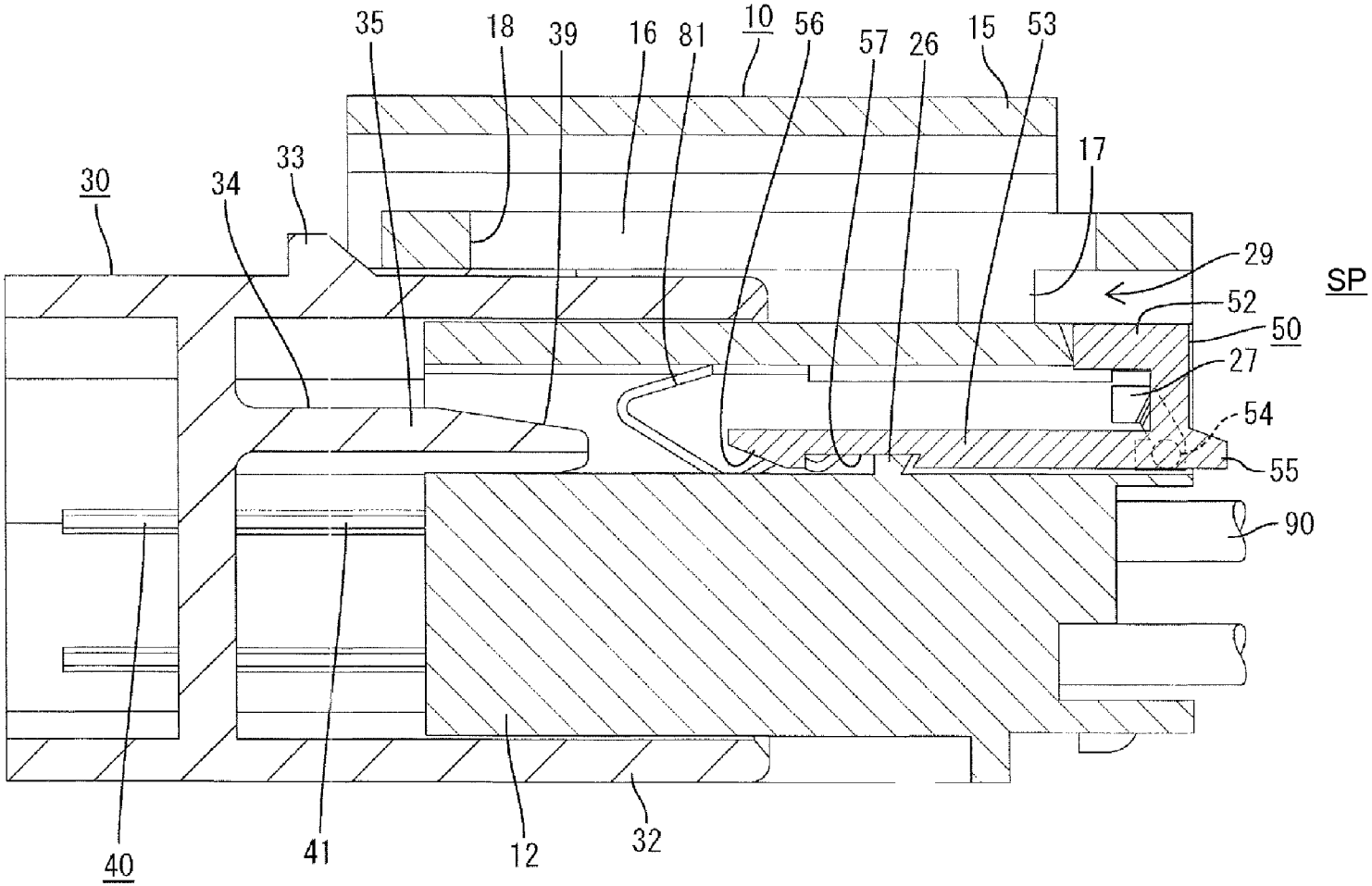
FIG. 2 is a cross section taken along line X-X of FIG. 1.
Figure 7:
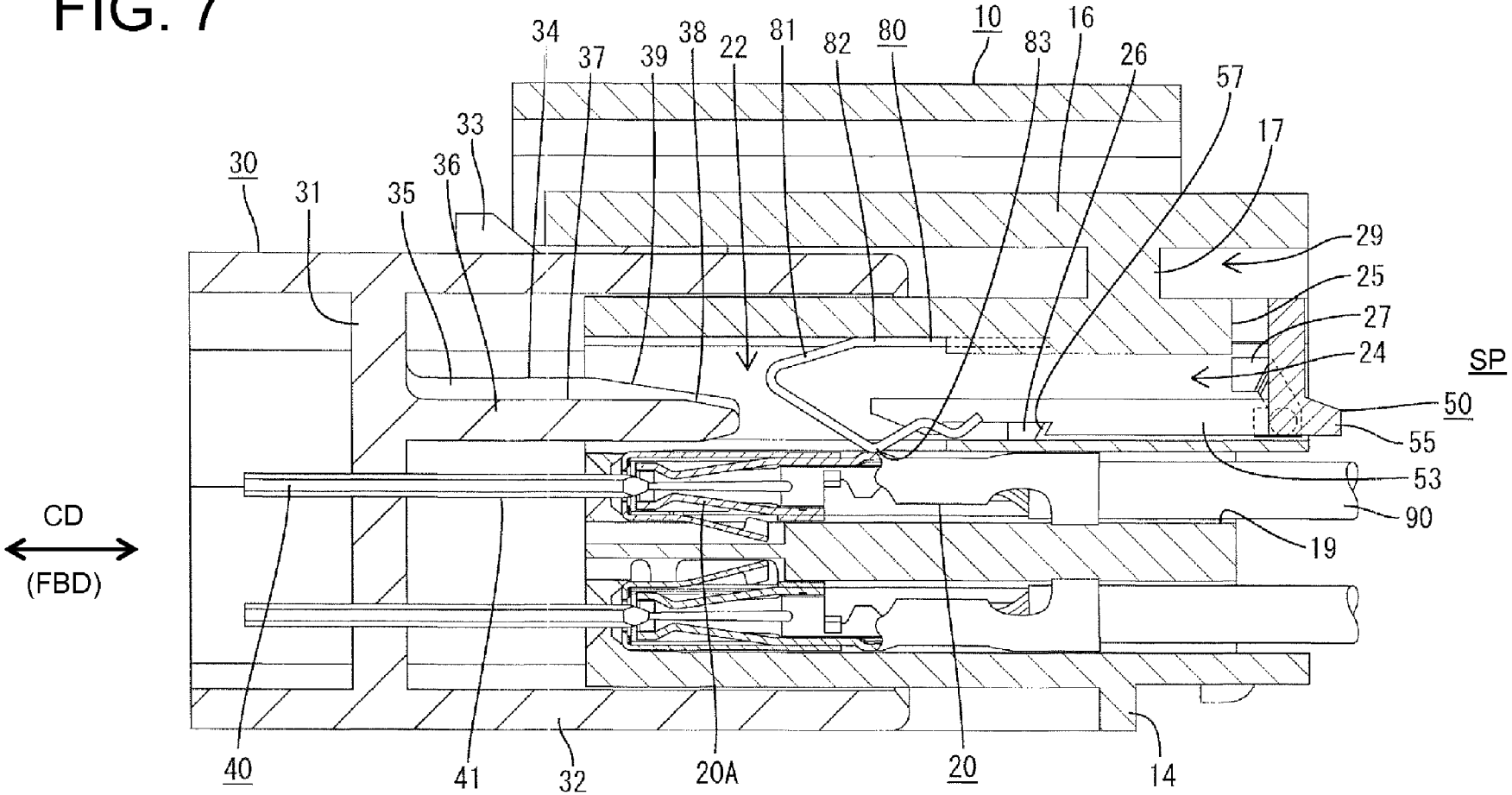
FIG. 7 is a cross section taken along line Y-Y section of FIG. 1.
Figure 10:
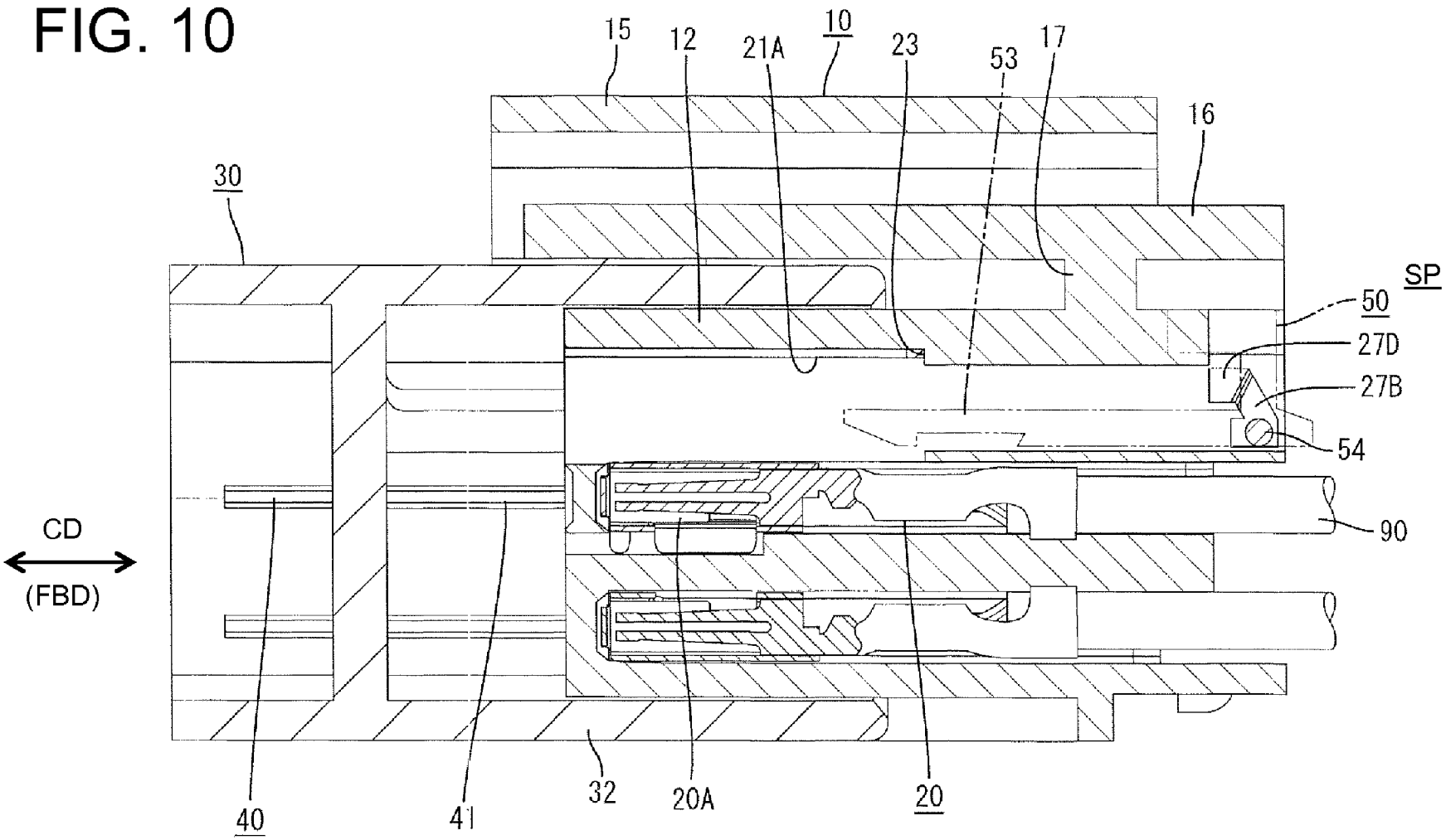
FIG. 10 is a cross section taken along line Z-Z section of FIG. 1.

The female housing 10 and the male housing 30 subsequently are connected along the connecting direction CD. Thus, the receptacle 32 is inserted into the clearance between the terminal accommodating portion 12 and the connecting portion 13 and the releasing portions 34 are inserted into the accommodation spaces 22 of the shorting-terminal accommodating chambers 21, as shown in FIGS. 2, 7 and 10. The three releasing portions 34 simultaneously move backward while being held in substantially sliding contact with the inner bottom surfaces of the corresponding shorting-terminal accommodating chambers 21.

The interlocking portion 33 contacts the front end of the lock arm 11 and causes the lock arm 11 to incline up. Thus, the beam 16 moves onto the interlocking portion 33 and the resilient contact pieces 81 of the shorting terminals 80 move onto the releasing guide surfaces 38 of the releasing portions 34 and deform resiliently away from the terminal fittings 20. In this way, the shorted state of the corresponding pairs of terminal fittings 20 is released.

Figure 3:
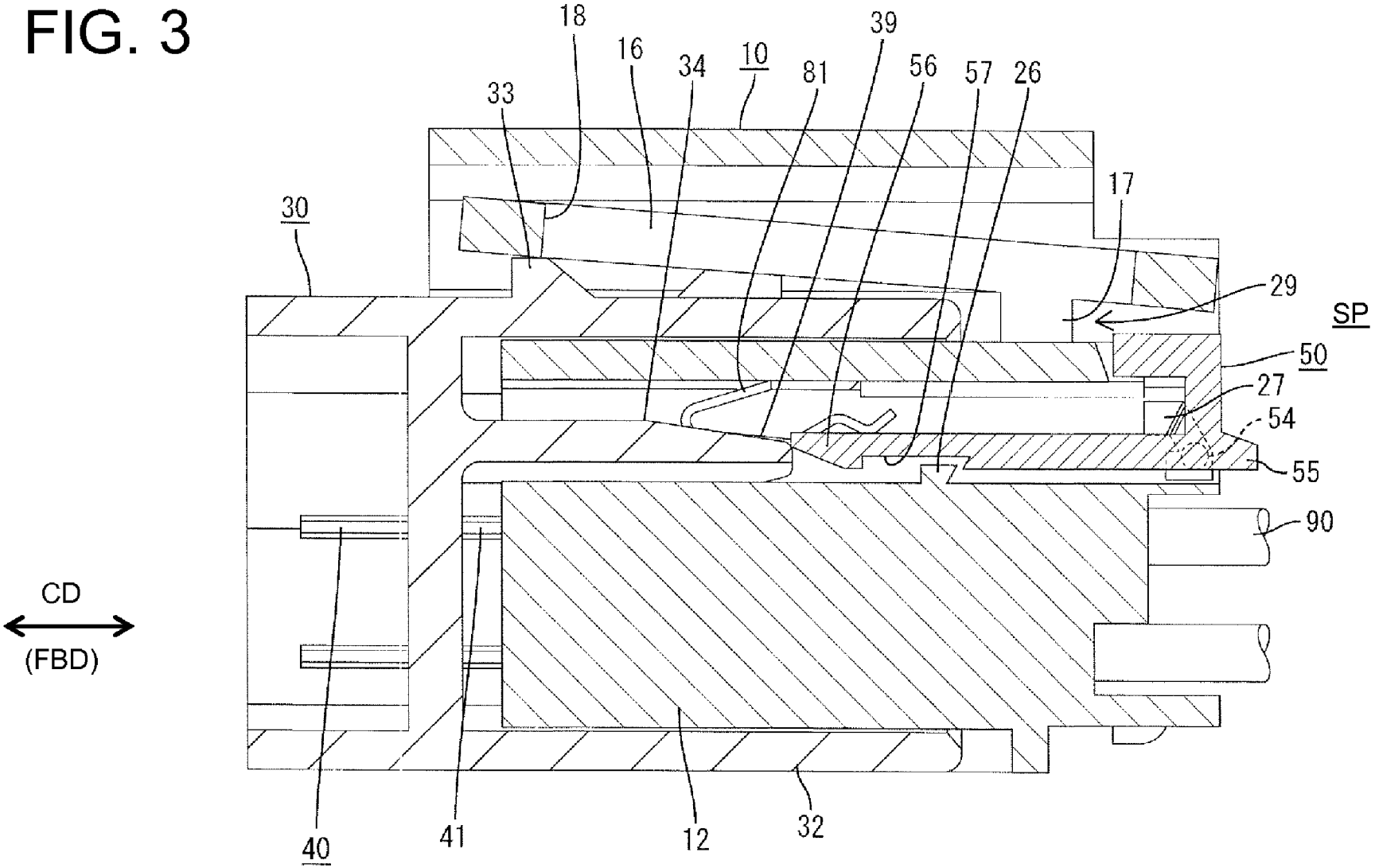
FIG. 3 is a cross section taken along line X-X of FIG. 1 when a shorted state of a pair of terminal fittings is released.

The resilient contact pieces 81 slide on the releasing slide surfaces 37 of the releasing portions 34 as the connecting operation proceeds and are kept resiliently deformed. Additionally, the engaging claw 56 of the detector 50 contacts the movement guide surface 39 of the releasing portion 34, as shown in FIGS. 3 and 8. The detector 50 then moves slightly back within the range of clearances of the horizontal standby side grooves 27A and the inner rear surface of the engaging groove 57 accordingly is separated from the rear surface of the stopper 26 to release a movement restricted state to the detection position DP. In this way, the detector 50 is permitted to move to the detection position DP after the shorted state of the pairs of terminal fittings 20 by the shorting terminals 80 is released. In other words, the shorted state of the pairs of terminal fittings 20 is guaranteed to have been released if the movement of the detector 50 to the detection position DP is permitted.

Figure 4:
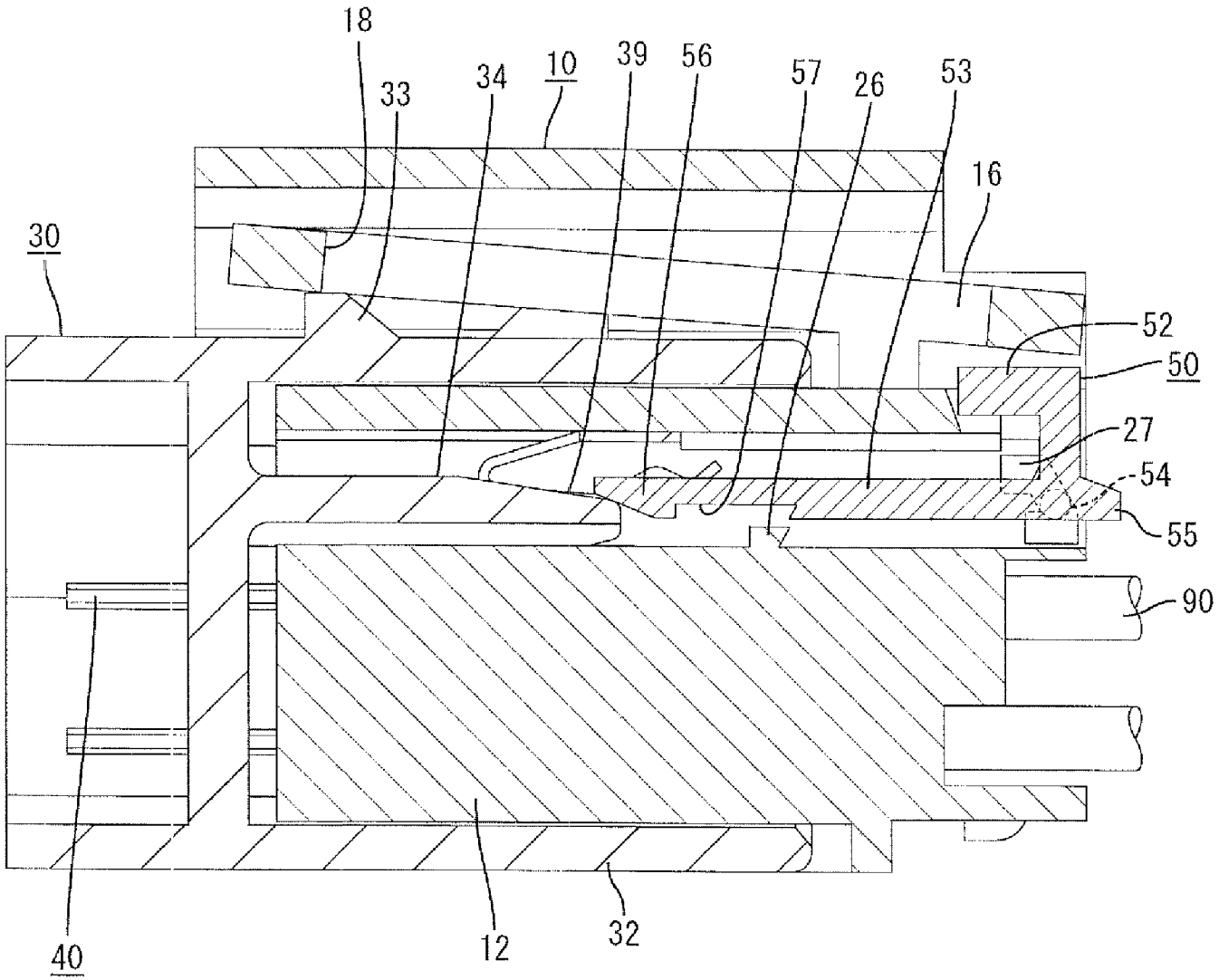
FIG. 4 is a cross section taken along line X-X of FIG. 1 when a movement of a detector to a detection position is permitted.
Figure 5:
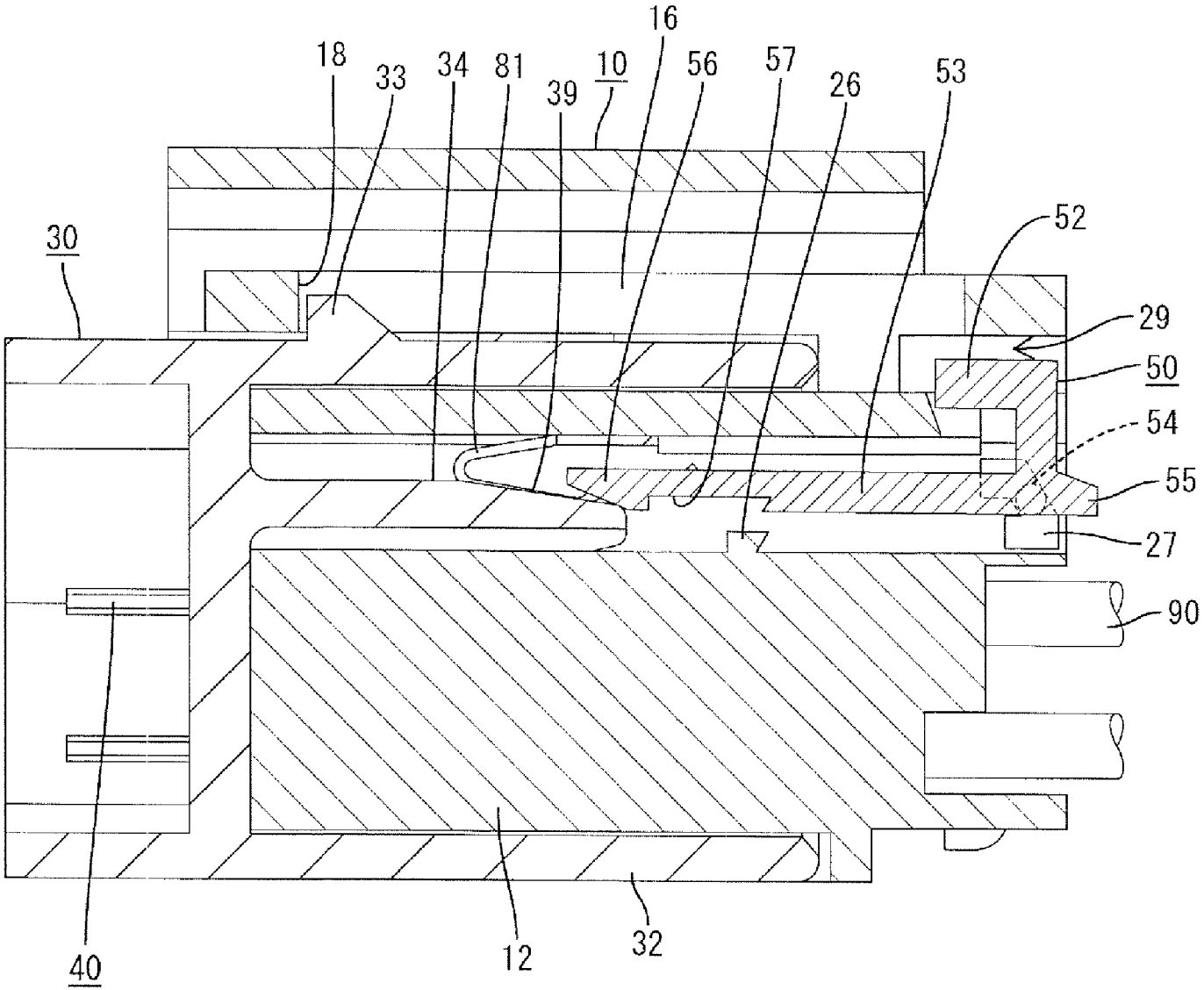
FIG. 5 is a cross section taken along line X-X of FIG. 1 when the detector reaches a temporary stop position.
Figure 9:
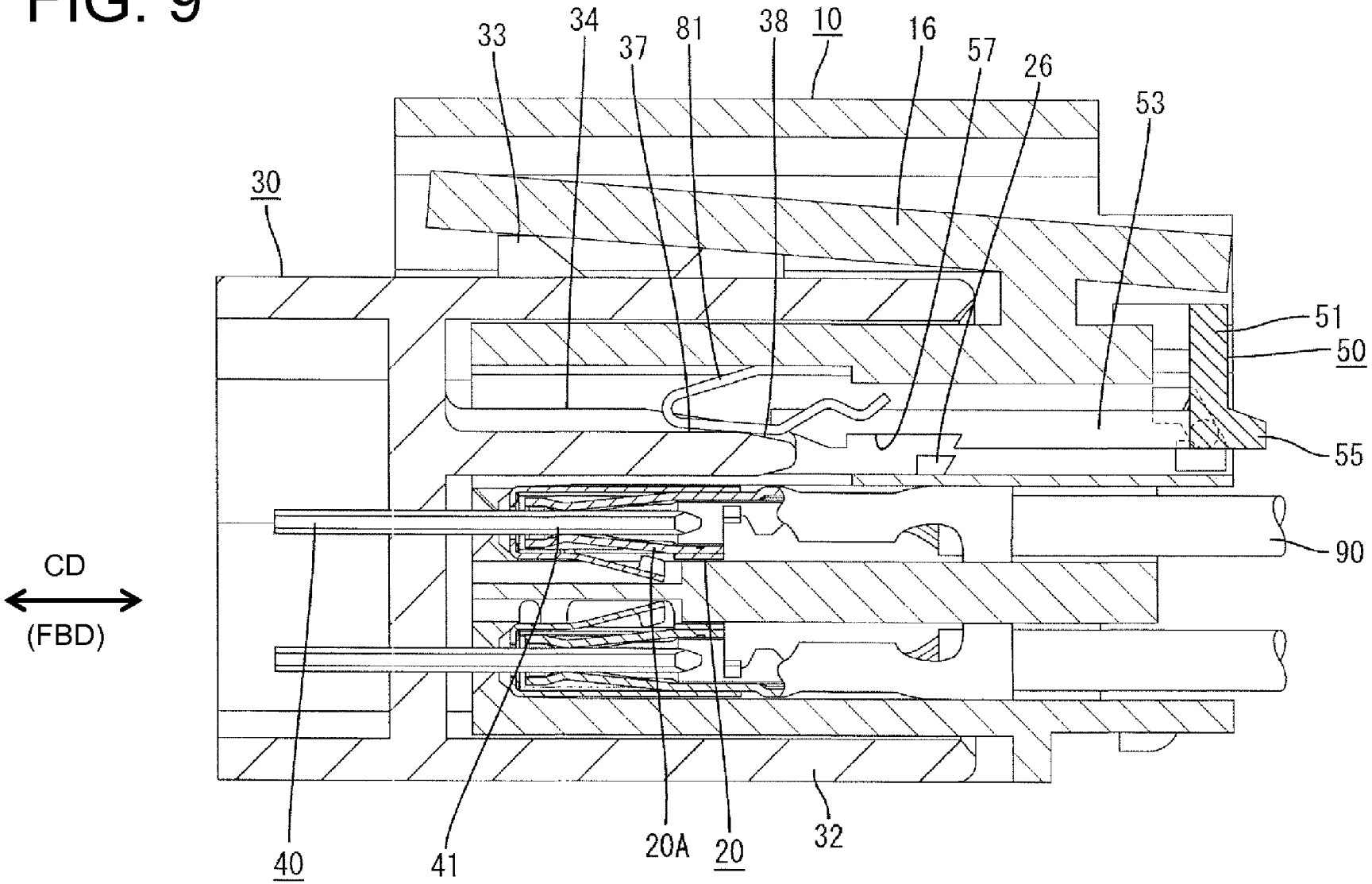
FIG. 9 is a cross section taken along line Y-Y section of FIG. 1 when the movement of the detector to the detection position is permitted.

The engaging claw 56 next moves onto the movement guide surface 39 of the releasing portion 34. As a result, the entire detector 50 is moved obliquely up towards the front and towards the detection position DP along the oblique grooves 27B while being kept in a substantially horizontal posture, as shown in FIGS. 4 and 9. The lock arm 11 engages the interlocking portion 33 when the two housings 10, 30 are connected properly in this way to lock the two housings 10, 30 in the connected state shown in FIG. 5. The engaging claw 56 of the detector 50 is kept in contact with the movement guide surface 39 of the releasing portion 34. Additionally, the guiding projections 54 reach the finishing ends of the oblique grooves 27B to contact the elongated projections 28 and the detector 50 is held forcibly at the temporary stop position TSP as shown in FIG. 11. At this temporary stop position, the engaging piece 53 is in the center of the mounting space 24 without touching anything and the entrance piece 52 is at a distance to the lower surface of the beam 16.

Figure 6:
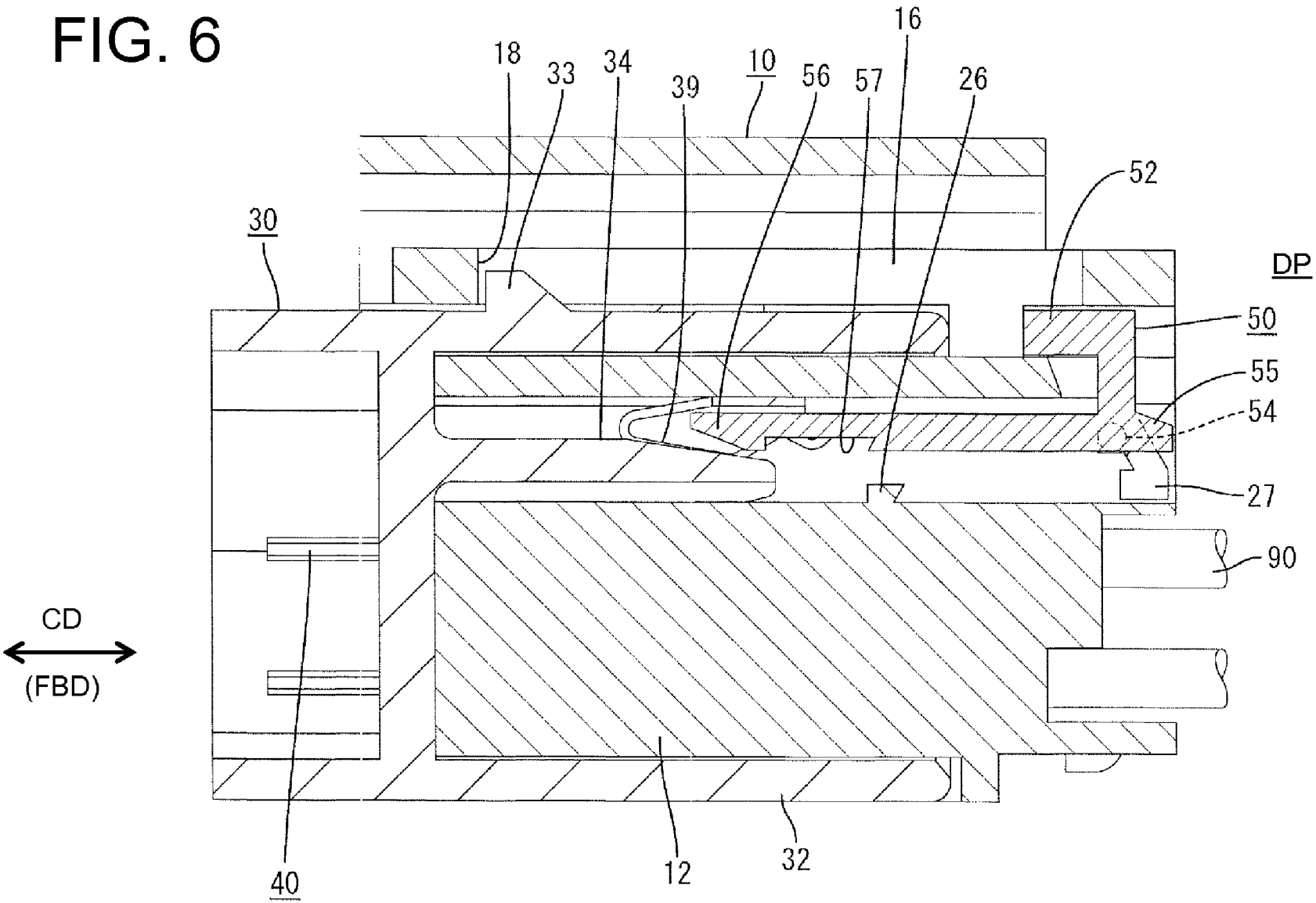
FIG. 6 is a cross section taken along line X-X of FIG. 1 when the detector reaches the detection position.

A forward pushing force then is exerted on the operating plate 51 of the detector 50. The guiding projections 54 then move resiliently over the elongated projections 28 to enter the entrances of the horizontal detection side grooves 27D and the guiding projections 54 move to the finishing ends of the horizontal detection side grooves 27D in a single stroke due to the inertia of the pushing operation. The detector 50 temporarily moves obliquely up towards the front when the guiding projections 54 move over the elongated projections 28, and thereafter moves substantially horizontally forward towards the detection position DP while the guiding projections 54 move in the horizontal detection side grooves 27D. The upper surface of the engaging piece 53 contacts the ceiling surface of the detecting-terminal accommodating chamber 21A when the detector 50 reaches the detection position DP. Additionally, the entrance piece 52 is fit into the entrance space 29 between the arm portion 16 and the terminal accommodating portion 12 and the detection rib 55 is retracted into the female housing 10 to be concealed therein as shown in FIGS. 6 and 12. At the detection position DP, the engaging claw 56 is separated from the movement guide surface 39 of the releasing portion 34.

On the other hand, if an attempt is made to push the detector 50 towards the detection position DP when the two housings 10, 30 are connected insufficiently, the entrance piece 52 contacts the lower surface of the beam 16 to hinder entry into the entrance space 29. An inability to move the detector 50 to the detection position DP indicates that the two housings 10, 30 are connected insufficiently. Therefore, the two housings 10, 30 may be brought to proper connection positions by being connected more deeply.

Movement of the detector 50 from the standby position SP to the detection position DP is permitted after the releasing portions 34 of the male housing 30 release the shorted state of the pairs of terminal fittings 20. Thus, the release of the shorted state of the pairs of terminal fittings 20 is detected mechanically if the movement of the detector 50 to the detection position DP is permitted. In this case, the detector 50 has an original function of detecting the connected state of the two housings 10, 30, and the construction of the connector can be simplified as compared to the case where an electrical detection is made, for example, by providing another detector 50.

The detector 50 is separated from the stopper 26 upon entering the female housing 10 and contacting the releasing portion 34. Thus, detection of whether a short circuit by the shorting terminal 80 has been opened is guaranteed accurately while being linked with the releasing operation of the shorting state of the shorting terminal 80. At this time, the releasing portion 34 is used commonly to release the shorting state and to move the detector 50. Therefore the construction of the connector is simplified further.

The detector 50 can be moved smoothly along the guiding grooves 27 as the two housings 10, 30 are connected. Further, since the accommodation space 22 for the shorting terminal 80 doubles as the mounting space 24 for the detector 50, the detector 50 can be mounted without significantly changing the construction of the existing female housing 10 and the female housing 10 need not enlarged.

The invention is not limited to the above described and illustrated embodiment. For example, the following embodiments are also embraced by the technical scope of the present invention as defined by the claims.

The detector may not have the function of detecting the connected state of the two housing by having only the function of detecting that the shorted state of the pair of terminal fittings by the shorting terminal has been released.

The detector may be mounted at an arbitrary position in the female housing.

The detector may be permitted to move toward the detection position by indirectly contacting the releasing portion with something interposed between the detector and the releasing portion.

A special releasing portion may be provided to move the detector.

The detector may be moved from the standby position to the detection position without the temporary stop position.

The shorting terminals and the detector may be provided in the male housing and the releasing portions may be provided in the female housing.

What is claimed is:

1. A connector, comprising:

a housing to be connected with a mating housing of a mating connector, at least two terminal fittings accommodated in the housing, at least one shorting terminal accommodated in the housing and adapted to contact and short terminal fittings, and a detector mounted on the housing and movable between a standby position and a detection position, the detector being capable of reaching the detection position only when the housing is connected properly with the mating housing, and the detector being permitted to move from the standby position to the detection position only after the shorted state of the terminal fittings is released by a releasing portion.

2. The connector of claim 1, wherein at least one stopper is provided in the housing for holding the detector at the standby position.

3. The connector of claim 2, wherein the detector is permitted to move to the detection position by being separated from the stopper upon entering the housing.

4. The connector of claim 1, wherein at least one guiding groove is provided in the housing for forming a movement path for the detector from the standby position to the detection position.

5. The connector of claim 4, wherein the guiding groove is within the height range of a detector accommodating chamber in the housing.

6. The connector of claim 4, wherein the guiding groove comprises:

a standby side groove extending substantially along a connecting direction of the housing backward from a starting end, an oblique groove extending obliquely out towards a front from a rear end of the standby side groove, and a detection side groove extending along the connecting direction forward from an upper end of the oblique groove, wherein the detector is movable from the starting end of the standby side groove to the finishing end of the detection side groove via the oblique groove with respect to the housing.

7. The connector of claim 1, wherein the housing has an accommodation space for the shorting terminal and for mounting the detector.

8. The connector of claim 1, wherein a movement path for the detector from the standby position to the detection position is defined such that the detector passes a temporary stop position where the movement of the detector is stopped temporarily.

9. The connector of claim 1, wherein a rear end of the detector is aligned substantially with a rear end surface of the housing when the detector reaches the detection position.

10. A connector assembly, comprising:

a housing;

at least two terminal fittings accommodated in the housing;

at least one shorting terminal accommodated in the housing and adapted to contact and short terminal fittings;

a mating housing connectable with the housing, at least one releasing portion in the mating housing for releasing a shorted state of the terminal fittings by the shorting terminal as the housing is connected with the mating housing; and a detector mounted on the housing and movable between a standby position and a detection position, the detector being capable of reaching the detection position only when the housing is connected properly with the mating housing, and the detector being permitted to move from the standby position to the detection position only after the shorted state of the terminal fittings is released by the releasing portion.

11. The connector assembly of claim 10, wherein at least one stopper is provided in the housing for holding the detector at the standby position.

12. The connector assembly of claim 11, wherein the detector is permitted to move to the detection position by being separated from the stopper while contacting the releasing portion upon entering the housing.

* * * * *

UNITED STATES PATENT AND TRADEMARK OFFICE

CERTIFICATE OF CORRECTION

PATENT NO. : 7,530,838 B2
APPLICATION NO. : 12/044199
DATED : May 12, 2009
INVENTOR(S) : Koji Ohara It is certified that error appears in the above-identified patent and that said Letters Patent is hereby corrected as shown below:

On the Title Page, Item (30) should be inserted to read

--(30) Foreign Application Priority Data

Mar. 9, 2007 (JP) ..... 2007-060037--.

Signed and Sealed this

Twenty-fifth Day of August, 2009

David J. Kappos

David J. Kappos
*Director of the United States Patent and Trademark Office*